United States Patent [19]

Pettit et al.

[11] 4,284,271

[45] Aug. 18, 1981

[54] HEXAGONAL JOGGING PLATFORM

[76] Inventors: John E. Pettit, 18219 - 46th Pl. South, Seattle, Wash. 98188; Thomas L. Pettit, 12112 52nd Ave. East, Tacoma, Wash. 98446

[21] Appl. No.: 20,739

[22] Filed: Mar. 15, 1979

[51] Int. Cl.[3] ..... A63B 23/04; A63B 5/18

[52] U.S. Cl. ..... 272/70; 5/233; 182/139; 272/65

[58] Field of Search ..... 272/65, 66, 135, 136, 272/137, 138, 139, 140, 142, 70; 182/139, 179, 170; 267/166, 179, 170, 155, 60, 61 R, 20 R, 20 A; 5/199, 210, 230, 231, 232, 233, 255, 256

[56] References Cited

U.S. PATENT DOCUMENTS

| | | | |
|---|---|---|---|
| 674,364 | 5/1901 | Brand | 5/210 |
| 1,189,963 | 7/1916 | Jones | 5/199 |
| 1,616,133 | 2/1927 | Lowy | 5/199 X |
| 1,756,413 | 4/1930 | Wilke et al. | 267/179 X |
| 2,553,105 | 5/1951 | Morey | 273/1.5 R |
| 3,233,895 | 2/1966 | Grelle et al. | 272/65 |
| 3,347,546 | 10/1967 | Abberly | 272/65 |
| 3,502,330 | 3/1970 | Cheftel | 272/65 X |
| 3,767,009 | 10/1973 | Sidlinger | 272/65 X |
| 3,831,936 | 8/1974 | Watson et al. | 272/65 |
| 3,892,403 | 7/1975 | Green | 272/65 |
| 4,037,834 | 7/1977 | Oaks | 272/70 X |

*Primary Examiner*—Richard C. Pinkham
*Assistant Examiner*—Arnold W. Kramer
*Attorney, Agent, or Firm*—LeBlanc, Nolan, Shur & Nies

[57] ABSTRACT

A hexagonal jogging platform having a tubular support frame with rounded corners, detachable, tubular support legs at each corner and a fabric platform attached to the tubular frame by novel coil springs having hooked ends bent from the axial center of the spring to prolong spring life. The legs are each rubber tipped with an insert disc or washer in the tip to prevent the leg from cutting through the tip. Each leg is bored to receive a tightening tool.

1 Claim, 4 Drawing Figures

FIG. 1
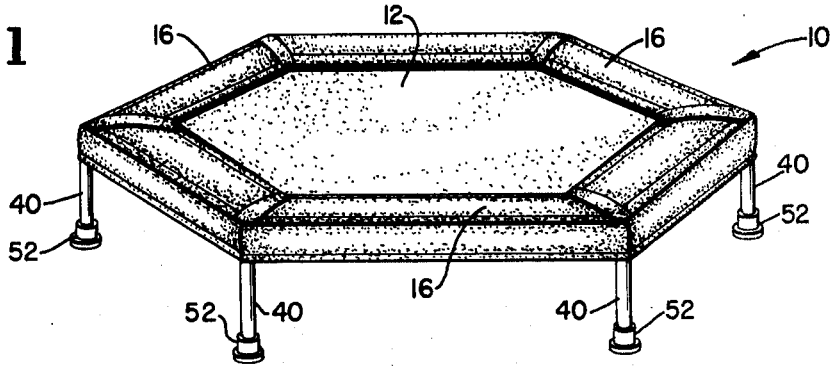
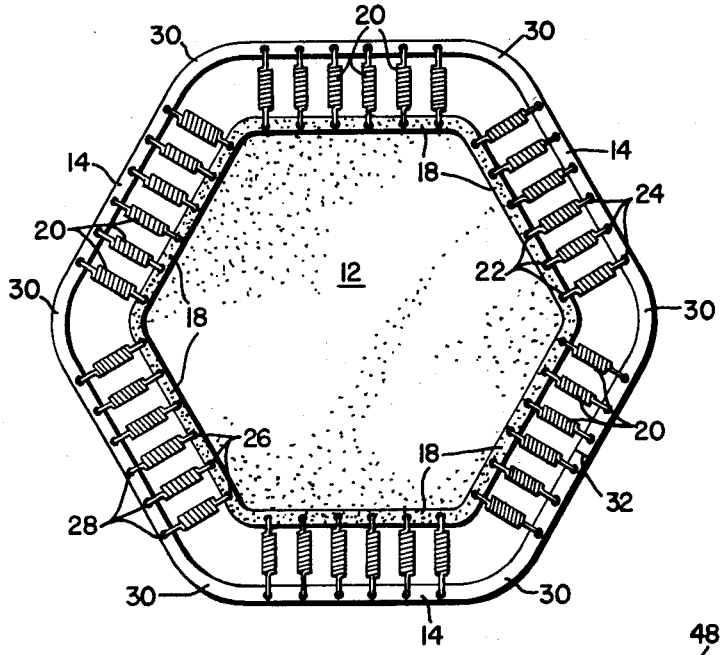
FIG. 2
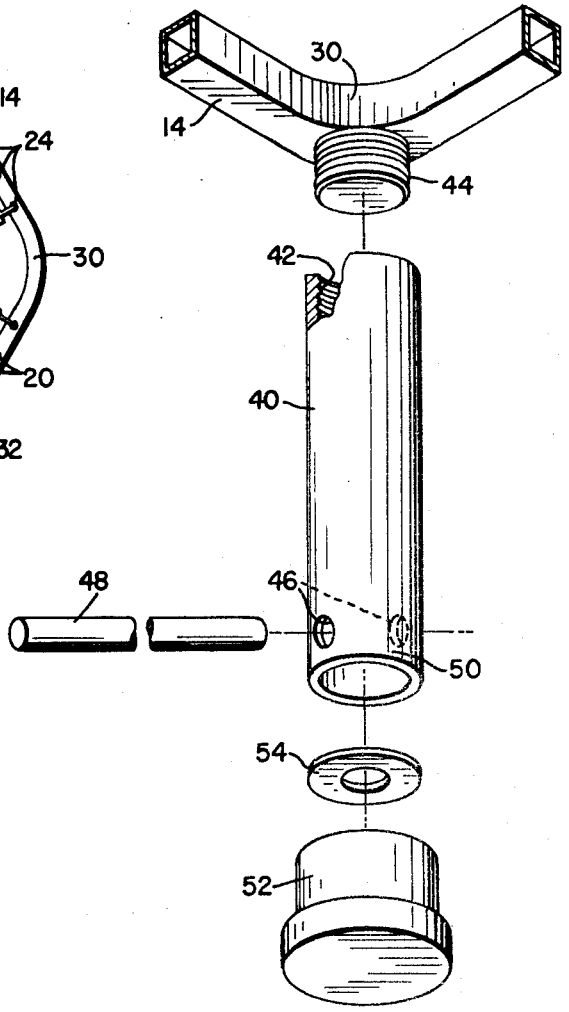
FIG. 3
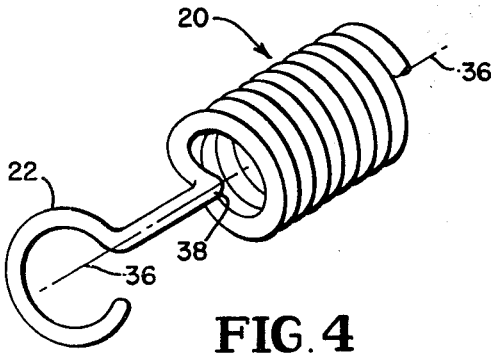
FIG. 4

HEXAGONAL JOGGING PLATFORM

BACKGROUND OF THE INVENTION

This invention relates generally to exercise devices and more particularly to a hexagonally shaped jogging platform designed for indoor use.

In recent years, significant numbers of the population have taken up the exercise of running or jogging. The health benefits of the exercise are myriad. Certainly overall physical fitness is improved and, more specifically, the benefits of jogging include improved muscle tone, increased stamina, better circulatory and respiratory function, weight control, improved coordination and relief of tension. In most areas of the country, jogging has become a year round activity.

Unfortunately, in some areas of the country, severe weather makes it impossible to always enjoy the activity of jogging outdoors. As a result, an indoor jogging platform was soon developed so that the exercise could be continued on a daily basis, in the comfort of one's own home, in spite of adverse climatic conditions.

A typical indoor jogging platform includes a rectangular frame about 3 feet square in dimension, leg supported on a floor by short legs, on the order of six to eight inches in length. The device includes a platform bed of fabric or other material tightly stretched by a coil spring arrangement attached to the frame. Simply stated, it has all the appearances of a miniature, square trampoline. One such jogging device is disclosed in U.S. Pat. No. 3,892,403, issued July 1, 1975 to Victor J. Green. A singular safety disadvantage of such a rectangular platform is that, should the user step upon an edge of the platform, it will become unbalanced and literally flip upwardly from the floor, causing potentially serious injury. In addition, such platforms have sharp corners that can also inflict serious injury on the user. The coil springs of typical jogging devices are usually unprotected by any covering or padding. Thus, a user could be hurt if he happens to land on that portion of the device between the fabric bed and the supporting frame. However, such a safety covering or padding is known in the trampoline art, as disclosed in U.S. Pat. No. 3,767,009, issued Oct. 23, 1973 to Bruce E. Sidlinger.

More exotic developments in the art are evidenced by U.S. Pat. Nos. 3,641,601 issued Feb. 15, 1972 to William F. Sieg and 4,037,834 issued July 26, 1977 to Arthur Q Oaks. The Sieg patent discloses a jogging device including a two-tread platform made of resilient foam material; a handle or grip structure may be provided for the safety of the user. The Oaks patent discloses a platform suspended from a frame of large diameter ABS plastic pipe by a combined cantilever—coil spring array. However, large potentially dangerous gaps are left between the platform edges and the supporting, plastic pipe frame.

The instant invention overcomes the aforementioned prior art deficiencies by providing a hexagonal jogging platform that cannot be upset no matter where the user stands or steps upon it. Equally important is the fact that a hexagonal structure is far stronger than a rectangular one, thus imparting long life to the invention.

SUMMARY OF THE INVENTION

Accordingly, it is a principal object of the invention to provide a hexagonal jogging platform which is safer to use and stronger in construction than prior art rectangular jogging structures.

It is another object of the invention to provide a hexagonal jogging platform having a fabric bed, coil spring supported from a steel frame, that area between the bed and frame being covered with a pad for the safety of the user.

It is a further object of the invention to provide a hexagonal jogging platform having a fabric bed, coil spring supported from a surrounding frame, each coil spring having hooked attachment ends bent from a point coincident with the axis of the coil spring so that load is applied axially and evenly throughout the spring to prolong spring life.

Yet another object of the invention is to provide a hexagonal jogging platform supported by detachable, threaded legs each of which is provided with through bores for mating fit with a simple tightening tool.

Yet a further object of the invention is to provide a hexagonal jogging platform having support legs, each being tipped with a tip of rubber or similar material, the tip being provided with a disc or washer insert to prevent the leg from cutting through the rubber tip.

It is still another object of the invention to provide a hexagonal jogging platform, the frame thereof having externally rounded corners or angles to minimize the possibility of injury to the user.

Generally speaking, the invention includes a hexagonal bed of fabric or other flexible material supported horizontally from a peripheral, hexagonal frame by a series of equispaced coil springs under tension. The frame has six legs, one at each angle of the hexagonal frame, each leg being threadably detachably mounted on a stud depending from a frame corner. Each leg further includes a tip of rubber or similar material, to prevent marring of a floor or other supporting surface, and a disc or washer insert within the tip to prevent the leg from cutting therethrough. A relatively small diameter bore may be formed laterally through each leg which receives a bar tool to securely tighten each leg during assembly of the invention. The hexagonal frame corners or angles are rounded to prevent injury to the user. Each coil spring has hooked ends bent from a point coincident with the axis of the spring coil so that tension load is applied evenly throughout the coil; this structure prolongs spring life.

Further novel features and other objects of this invention will become apparent from the following detailed description, discussion and the appended claims taken in conjunction with the accompanying drawings.

BRIEF DESCRIPTION OF DRAWINGS

A preferred structural embodiment of this invention is disclosed in the accompanying drawings in which:

FIG. 1 is a perspective view of the invention;

FIG. 2 is a top, plan view of the invention illustrated in FIG. 1, with the protective, peripheral pad removed to reveal the underlying coil spring structure;

FIG. 3 is an exploded view of one support leg of the jogging platform frame; and FIG. 4 is a partial perspective view of one of the coil springs supporting the bed of the jogging platform.

DESCRIPTION OF THE PREFERRED EMBODIMENTS

Referring now to the drawings by reference character, a jogging platform 10 is illustrated in FIG. 1 including a hexagonally shaped flexible bed 12 of fabric or similar material supported from a surrounding frame 14 (FIG. 2) spaced concentrically outwardly from bed 12 as shown in the top, plan view of FIG. 2. A hexagonally shaped protective cover or pad 16 surrounds frame 14 and the space defined between hemmed margins 18 of bed 12 and frame 14.

Bed 12 is supported within frame 14 by a series of six sets of six equispaced coil springs 20 distributed evenly about margins 18 and frame 14. Each coil spring 20 includes hooked attaching ends 22 and 24. Margins 18 may be provided with a series of grommets 26 to receive hooked ends 22 and frame 14 is provided with a series of bores about the top surface thereof, within which are placed a series of inserts 28 to receive hooked ends 24. Inserts 28 are relatively free to rotate within their bores to prevent chafing and wear of hooked ends 24 when jogging platform 10 is in use. (Reference numerals have been applied sparingly in FIG. 2 in order to enhance clarity of the overall figure).

Frame 14, in a preferred embodiment, is made of a single length of rectangular, tubular bar stock (FIG. 3), bent as shown into a hexagon, the six corners or angles 30 thereof being gently curved so that no sharp corners are present which could possibly injure a user, should he inadvertently step on an angle 30. The ends of the bar stock forming frame 14 may simply be butt-welded to complete frame 14, as indicated at weld line 32.

Each coil spring 20 is made of central spiral body of spring material (e.g., steel wire) of predetermined even diameter throughout its length to thereby define a central axis, illustrated by phantom line 36 in FIG. 4. Most such coil springs used in jogging platforms, trampolines and similar devices have hooked ends bent from the periphery of the coil spring body (for example, as indicated in FIG. 3 of the Sidlinger U.S. Pat. No. 3,767,009 hereinbefore discussed). In the instant invention, ends 38 of the spring body terminate at a point coincident with axis 36. The hooked attaching ends of the coil spring, such as 22, are then bent and formed outwardly from end 38. This structure greatly prolongs spring life in that tension forces are thus applied centrally along the entire coil spring without the damaging, off-center bending load forces applied in conventional coil spring structures. Such conventional coil springs tend to fracture rather readily, particularly at the junction point of the hooked, attaching ends and the central, spiral spring body.

Frame 14 is supported on a floor or other horizontal surface by six legs 40, attached to frame 14 at the six angles 30 thereof, one of which is illustrated in FIG. 3. Each leg 40 is made of a short length of tubular stock with an upper end 42 being internally threaded for attachment to an externally threaded stud 44 welded to the bottom of angle 30 of frame 14. Detachable legs are provided to reduce packaging and shipping costs. Normally, the ultimate purchaser will attach legs 40 to the frame prior to using the invention.

To facilitate the attaching of legs 40 to studs 44 and to further assure, as a safety precaution, that each leg 40 is indeed firmly secure, the lower end of each leg 40 is provided with a lateral, relatively small diameter through bore 46 which matingly receives a simple tightening tool in the form of a bar 48. Bar 48 will be packaged with the invention, ordinarily. The tool may be retained by the purchaser should he wish to remove legs 40 for the purpose of storing the invention.

The lower end 50 of each leg 40 is provided with a tip 52 of rubber or similar material in order to prevent marring of or damage to a floor or other support surface for the invention. However, the exercise of jogging may likely drive one or more legs 40 right through one or more tips 52, thus destroying the tip and damaging the floor. To prevent such damage, each tip has a disc or washer insert 54 placed therewithin. Of course, the diameter of each insert 54 is the same as the external diameter of leg end 50.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A hexagonal jogging platform comprising: a generally hexagonally shaped, horizontally disposed frame; a flat, hexagonally shaped bed of flexible material disposed concentrically within said frame and having margins thereabout spaced from said frame; a series of spring means under tension interconnecting said bed margins and frame along the six sides thereof, respectively; leg support means depending from said frame at the six angles thereof; and hexagonally shaped pad means overlying and covering said spring means between said frame and bed margins; said frame being shaped to have external, rounded corners thereon at each of the six angles thereof and being of integral, one-piece construction; said series of spring means comprising six sets of six equispaced coil springs, each of said coil springs having integral hooked attaching ends thereon, each hooked end being bent from said coil spring at a point coincident with a central axis defined centrally through the coil of said coil spring whereby load is applied to said coil spring evenly and centrally therealong to prolong spring life; each of said support leg means comprising a tubular leg, means threadably detachably interconnecting said frame and leg, means defining a lateral bore through said leg for matingly receiving a hand held tool for rotating said leg, a protective tip fitted onto and over a lower end of said leg, and a flat circular insert within said tip having an external diameter the same as that of said leg and retained against said leg lower end solely by said tip, said insert preventing damage to said tip due to a force applied by said leg lower end therewithin.

* * * * *